US010276975B1

(12) United States Patent
Peng

(10) Patent No.: US 10,276,975 B1
(45) Date of Patent: Apr. 30, 2019

(54) ELECTRICAL CONNECTOR

(71) Applicant: LOTES CO., LTD, Keelung (TW)

(72) Inventor: Zhi Guo Peng, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/906,232

(22) Filed: Feb. 27, 2018

(30) Foreign Application Priority Data

Oct. 24, 2017 (CN) ..... 2017 1 0998886

(51) Int. Cl.

| | |
|---|---|
| ***H01R 13/62*** | (2006.01) |
| ***H01R 13/627*** | (2006.01) |
| ***H01R 13/405*** | (2006.01) |
| ***H01R 13/6581*** | (2011.01) |
| ***H01R 13/6585*** | (2011.01) |

(52) U.S. Cl.
CPC ..... *H01R 13/6273* (2013.01); *H01R 13/405* (2013.01); *H01R 13/6581* (2013.01); *H01R 13/6585* (2013.01)

(58) Field of Classification Search
CPC ..... H01R 13/6273
See application file for complete search history.

(56) References Cited

U.S. PATENT DOCUMENTS 9,306,345 B2 * 4/2016 Hsu ..... H01R 13/6582

FOREIGN PATENT DOCUMENTS

| | | |
|---|---|---|
| CN | 202474421 U | 10/2012 |
| CN | 104241975 B | 6/2017 |

* cited by examiner

*Primary Examiner* — Ross N Gushi
(74) *Attorney, Agent, or Firm* — Locke Lord LLP; Tim Tingkang Xia, Esq.

(57) ABSTRACT

An electrical connector is configured to be mated with a mating connector. The electrical connector includes an insulating body having a front end backward concavely provided with an insertion cavity. Multiple first and second terminals are accommodated in the insulating body. The first and second terminals are partially exposed from a top surface and a bottom surface of the insertion cavity, respectively. A shielding sheet has a main body portion located between the first and second terminals. The main body portion has a first latch arm extending out of the insulating body. A plate surface of the first latch arm and a plate surface of the main body portion form an angle. A shielding shell covers the insulating body, and has an accommodating hole corresponding to the first latch arm. The first latch arm is located in the accommodating hole and partially exposed from the shielding shell.

20 Claims, 10 Drawing Sheets

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201710998886.7 filed in China on Oct. 24, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector capable of maintaining a plugging force.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the development of Internet and electronic products, electronic products such as mobile phones have become indispensable to human lives. An electrical connector is necessary to transmit data from a mobile phone and to charge the mobile phone. Therefore, the electrical connector is more frequently used and more highly required.

An electrical connector in the current market includes an insulating body. Multiple terminals in upper and lower rows are accommodated in the insulating body. A shielding sheet is accommodated in the insulating body and located between the upper row terminals and the lower row terminals. The shielding sheet has a pair of latch arms for buckling a tongue of a mating connector, thus providing a plugging force to ensure that the electrical connector operates normally. However, as the electrical connector is more frequently used, abrasion of the tongue is caused by frequent plugging, and the latch arms cannot operate normally, such that the electrical connector cannot operate normally due to a poor contact.

Therefore, a heretofore unaddressed need to design an improved electrical connector exists in the art to address the aforementioned deficiencies and inadequacies.

SUMMARY

In view of the above problem in the related art, the present invention is directed to an electrical connector, which has a shielding sheet. A first latch arm and a main body portion of a shielding sheet form an angle, and the first latch arm latches a covering shell of a mating connector, thereby preventing from abrasion to a tongue of the mating connector from abrasion, and maintaining a sufficient plugging force.

To achieve the foregoing objective, the present invention adopts the following technical solutions.

An electrical connector, configured to be mated with a mating connector, includes: an insulating body, wherein a front end of the insulating body is backward concavely provided with an insertion cavity; a plurality of first terminals and a plurality of second terminals, accommodated in the insulating body respectively, the first terminals being partially exposed from a top surface of the insertion cavity, and the second terminals being partially exposed from a bottom surface of the insertion cavity; a shielding sheet, accommodated in the insulating body, and having a main body portion located between the first terminals and the second terminals, wherein the main body portion has at least one first latch arm extending out of the insulating body, a plate surface of the at least one first latch arm and a plate surface of the main body portion form an angle, and the at least one first latch arm is configured to latch the mating connector during mating; and a shielding shell, covering the insulating body, the shielding shell having an accommodating hole corresponding to the at least one first latch arm, wherein the at least one first latch arm is located in the accommodating hole and partially exposed from the shielding shell.

In certain embodiments, the plate surface of the at least one first latch arm is perpendicular to the plate surface of the main body portion.

In certain embodiments, at least one accommodating groove is downward concavely provided on an upper surface of the insulating body or upward concavely provided on a lower surface of the insulating body, and the at least one first latch arm is accommodated in the at least one accommodating groove.

In certain embodiments, the main body portion has at least two first latch arms, and at least two accommodating grooves are correspondingly provided on the insulating body; one of the at least two accommodating grooves is downward concavely provided on an upper surface of the insulating body, and another one of the at least two accommodating grooves is upward concavely provided on a lower surface of the insulating body; and the at least two first latch arms are respectively accommodated in the at least two accommodating grooves.

In certain embodiments, a first hook portion extends from an end of each of the at least one first latch arm away from the main body portion, the first hook portion extends away from the insertion cavity, the first hook portion is located in the accommodating hole and exposed from the shielding shell, and the first hook portion is configured to latch the mating connector during mating.

In certain embodiments, each of two sides of the main body portion is provided with a bending portion, and the bending portion is connected to the at least one first latch arm.

In certain embodiments, at least one soldering portion extends backward from the main body portion out of the insulating body.

In certain embodiments, the main body portion further has two second latch arms, each of the second latch arms extends forward from one of two sides of the main body portion, the second latch arms are located on two transverse sides of the insertion cavity and exposed from the insertion cavity, and the main body portion and the second latch arms are located on a same plane.

In certain embodiments, the second latch arms and the at least one first latch arm are not located at a same level of height.

In certain embodiments, the at least one first latch arm and the second latch arms are staggered in a vertical direction.

In certain embodiments, the second latch arms and the at least one first latch arm are sequentially arranged outward from a lateral direction of the main body portion.

In certain embodiments, a second hook portion extends from an end of each of the second latch arms away from the main body portion, the second hook portion extends into the insertion cavity, and the second hook portion is configured to latch the mating connector during mating.

In certain embodiments, each of two sides of each of the second latch arms is provided with a bending portion, and the bending portion is connected to the at least one first latch arm.

Moreover, the present invention also adopts another technical solution. An electrical connector, configured to be mated with a mating connector, includes: an insulating body, wherein a front end of the insulating body is backward concavely provided with an insertion cavity; a plurality of first terminals and a plurality of second terminals, accommodated in the insulating body respectively, the first terminals being located on a top surface of the insertion cavity, the second terminals being located on a bottom surface of the insertion cavity, and each of the first terminals and each of the second terminals having a contact portion exposed from the insertion cavity respectively; a shielding sheet, accommodated in the insulating body, and having a main body portion located between the first terminals and the second terminals, wherein the main body portion has at least one first latch arm extending out of the insulating body, a plate surface of the at least one first latch arm and a plate surface of the main body portion form an angle, the main body portion further has two second latch arms, each of the second latch arms extends forward from one of two sides of the main body portion, the second latch arms are located on two transverse sides of the insertion cavity and exposed from the insertion cavity, the second latch arms and the at least one first latch arm are not located at a same level of height, and the at least one first latch arm and the second latch arms are configured to latch the mating connector during mating; and a shielding shell, covering the insulating body, the shielding shell having an accommodating hole corresponding to the at least one first latch arm, wherein the at least one first latch arm is located in the accommodating hole and partially exposed from the shielding shell.

In certain embodiments, the plate surface of the at least one first latch arm is perpendicular to the plate surface of the main body portion.

In certain embodiments, at least one accommodating groove is downward concavely provided on an upper surface of the insulating body or upward concavely provided on a lower surface of the insulating body, and the at least one first latch arm is accommodated in the at least one accommodating groove.

In certain embodiments, there are two first latch arms, a first hook portion extends from an end of each of the two first latch arms away from the main body portion, the first hook portion extends away from the insulating body, the first hook portion is located in the accommodating hole and exposed from the shielding shell, and the first hook portion is configured to latch the mating connector during mating.

In certain embodiments, the second latch arms and the main body portion are on a same plane.

In certain embodiments, each of the second latch arms has a bending portion, the bending portion is connected to the at least one first latch arm, and the at least one first latch arm and the second latch arms are staggered in a vertical direction.

In certain embodiments, a second hook portion extends from an end of each of the second latch arms away from the main body portion, the second hook portion extends into the insertion cavity, and the second hook portion is configured to latch the mating connector during mating.

Compared with the related art, certain embodiments of the present invention has the following beneficial effects.

The electrical connector of the present invention is provided with a shielding sheet accommodated in the insulating body, and the shielding sheet has a main body portion located between the first terminals and the second terminals. The main body portion has at least one first latch arm extending out of the insulating body. A plate surface of the first latch arm and a plate surface of the main body portion form an angle, and the first latch arm is configured to latch the mating connector during mating. The first latch arm is latched to the covering shell of the mating connector, so as to provide a sufficient plugging force, and prevent from abrasion to the tongue of the mating connector, thereby ensuring that the electrical connector operates normally, and prolonging the service life of the mating connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
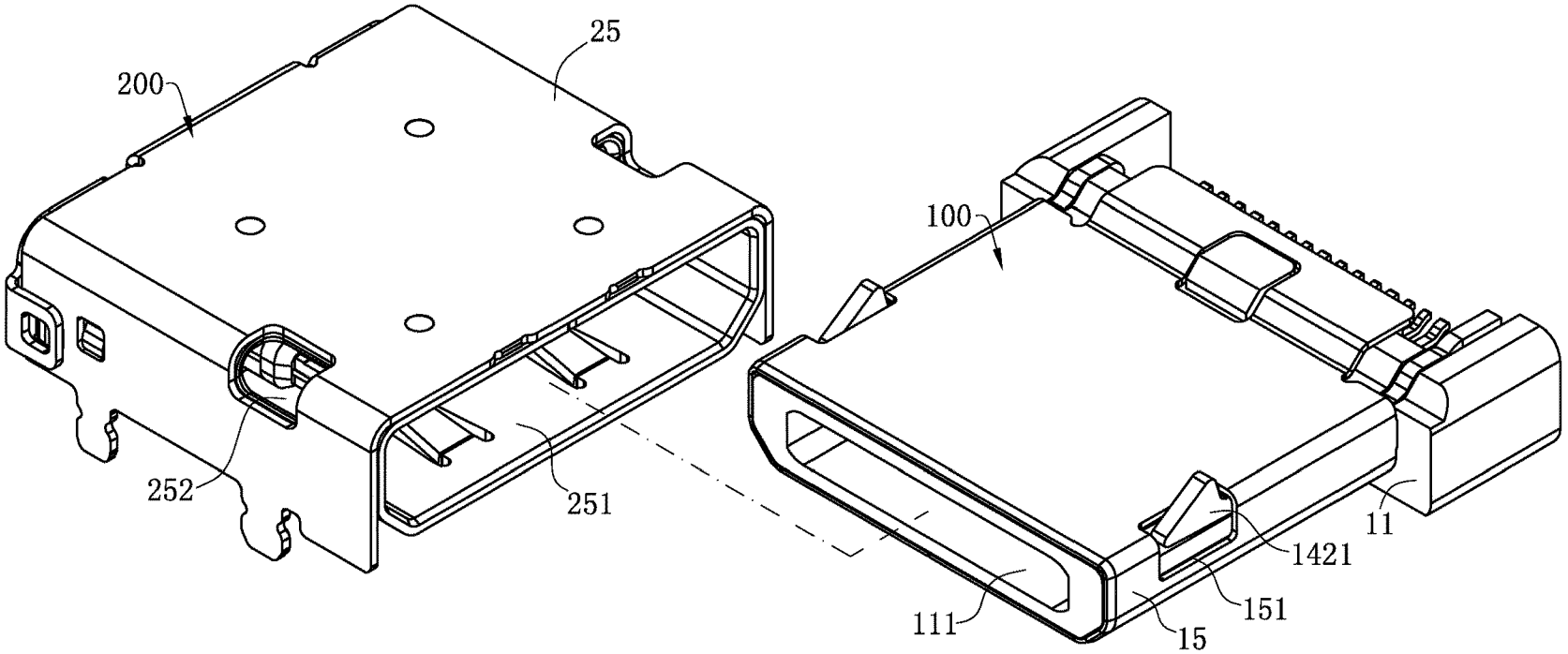
FIG. 1 is a perspective assembled view of an electrical connector and a mating connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector.

Figure 2:
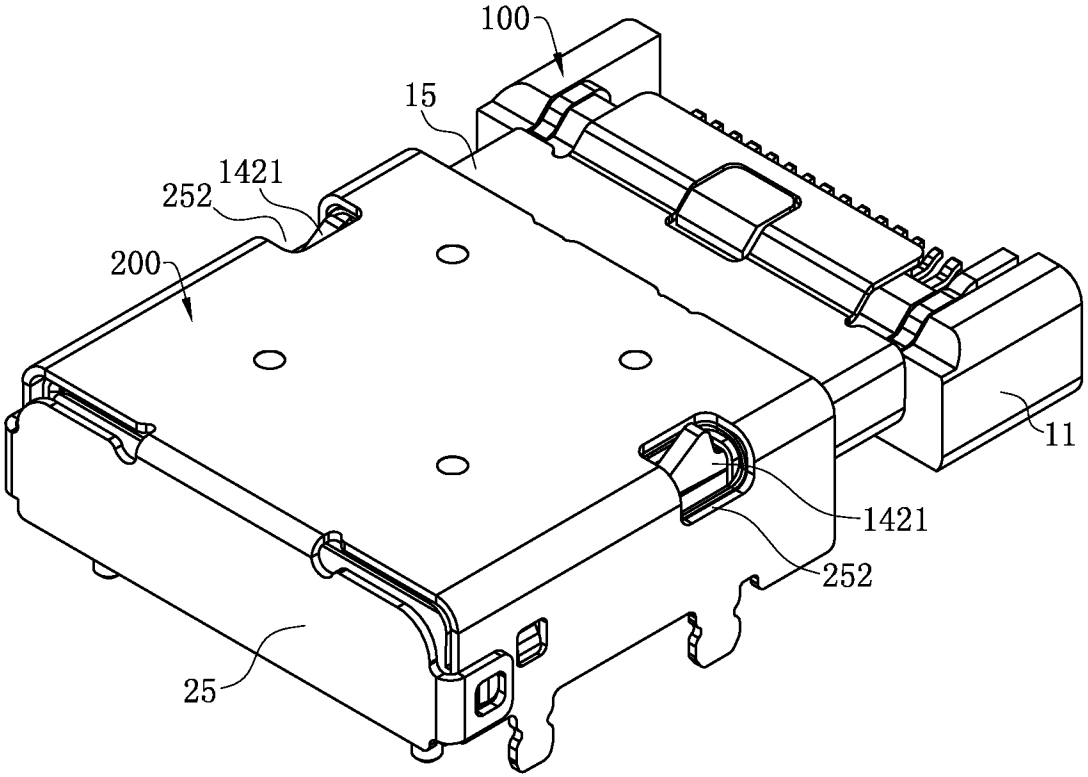
FIG. 2 is a schematic view of mating of the electrical connector and the mating connector according to the first embodiment of the present invention.
Figure 3:
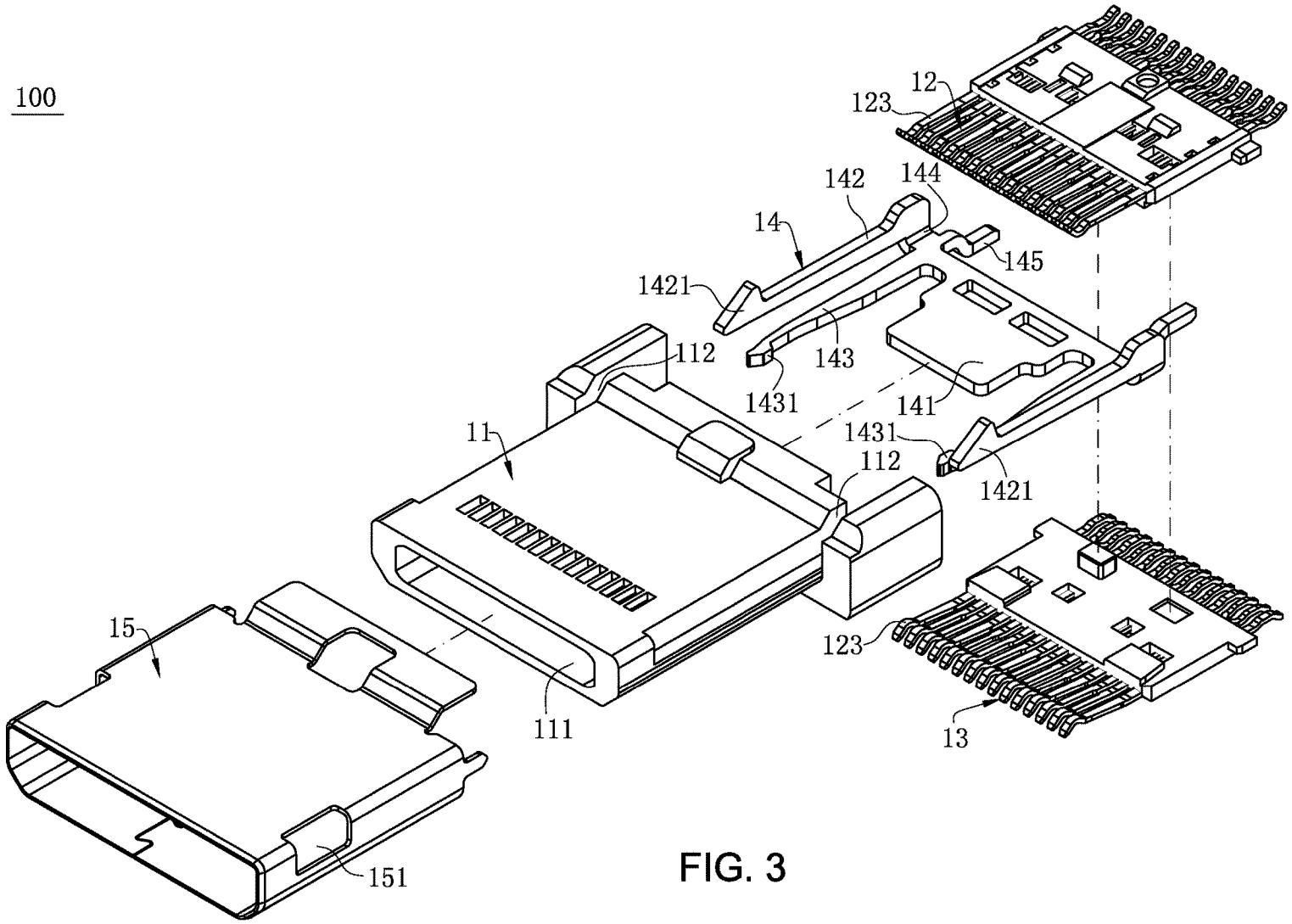
FIG. 3 is a perspective exploded view of the electrical connector according to the first embodiment of the present invention.

FIGS. 1-8 schematically show a first embodiment of the present invention. As shown in FIG. 1, FIG. 2 and FIG. 3, an electrical connector 100 according to certain embodiments of the present invention is used for mating with a mating connector 200, and includes an insulating body 11, multiple first terminals 12 and multiple second terminals 13 being accommodated in the insulating body 11, and a shielding shell 15 being sleeved over the insulating body 11.

As shown in FIG. 3, a front end of the insulating body 11 is backward concavely provided with an insertion cavity 111. An accommodating groove 112 is downward concavely provided on an upper surface of the insulating body 11. The insertion cavity 111 is configured for inserting the mating connector 200.

Figure 4:
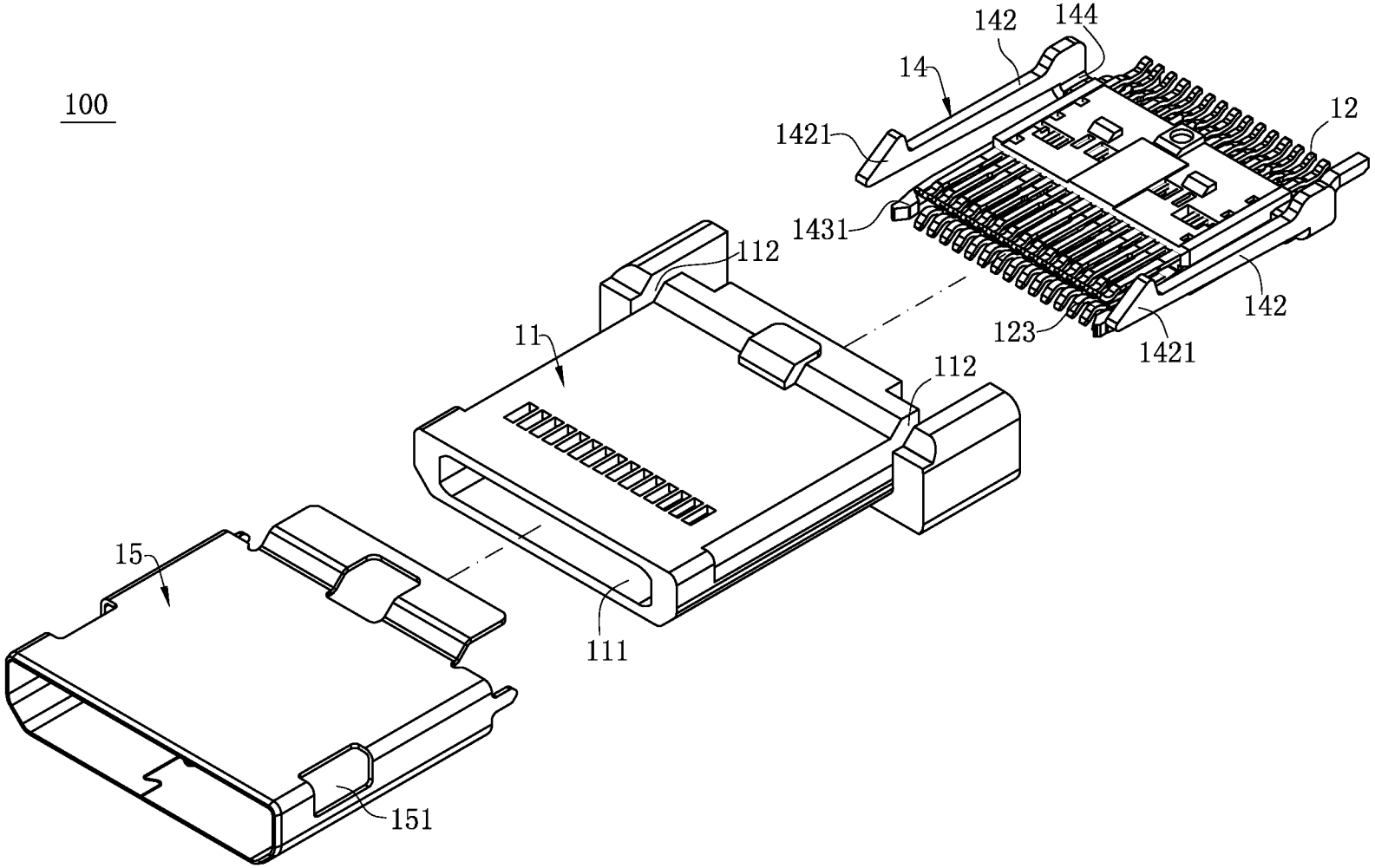
FIG. 4 is a perspective exploded view of the electrical connector according to the first embodiment of the present invention viewed from another viewing angle.
Figure 5:
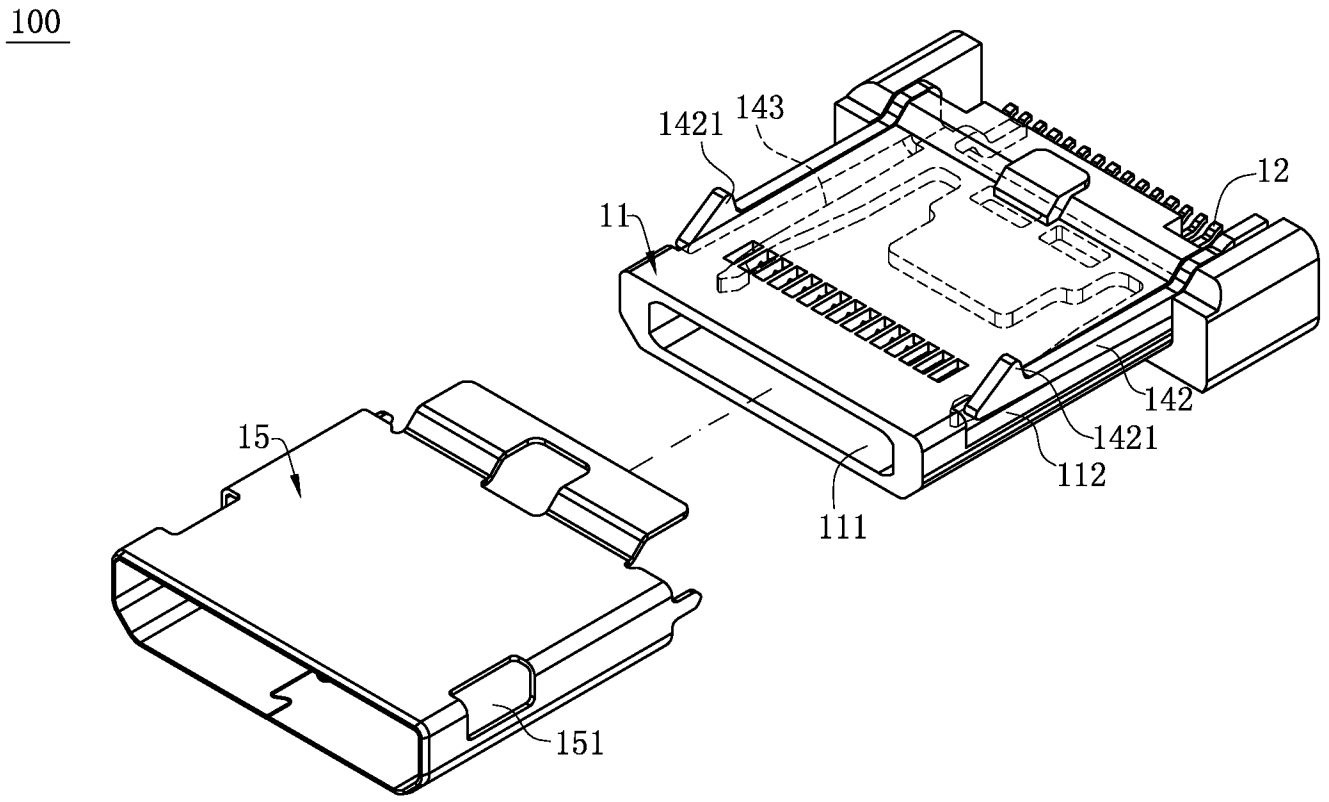
FIG. 5 is a perspective assembled view of the electrical connector according to the first embodiment of the present invention.

As shown in FIG. 4 and FIG. 5, the first terminals 12 are located on a top surface of the insertion cavity 111 respectively, and the second terminals 13 are located on a bottom surface of the insertion cavity 111 respectively. Each of the first terminals 12 and each of the second terminals 13 have a contact portion 123 exposed from the insertion cavity 111, respectively.

As shown in FIG. 3, FIG. 4 and FIG. 5, a shielding sheet 14 is accommodated in the insulating body 11. The shielding sheet 14 has a main body portion 141 located between the first terminals 12 and the second terminals 13. The main body portion 141 has two second latch arms 143, and each of the second latch arms 143 extends forward from one of two sides of the main body portion 141. The second latch arms 143 and the main body portion 141 are located on a same plane. The second latch arms 143 are located on two transverse sides of the insertion cavity 111 and partially exposed from the insertion cavity 111. A second hook portion 1431 extends from an end of each of the second latch arms 143 away from the main body portion 141 toward the insertion cavity 111, and the second hook portion 1431 is configured to latch the mating connector 200 during mating.

A bending portion 144 bends and extends upward vertically from a rear end of each of the second latch arms 143. A first latch arm 142 extends forward from the bending portion 144. The first latch arm 142 is accommodated in the accommodating groove 112, and a plate surface of the first latch arm 142 and the main body portion 141 form an angle. In the present embodiment, the plate surface of the first latch arm 142 is perpendicular to the main body portion 141. A first hook portion 1421 extends from an end of the first latch arm 142 away from the main body portion 141. The first hook portion 1421 extends away from the insulating body 11, and the first hook portion 1421 is located in the accommodating hole 151 and exposed from the shielding shell 15. The first hook portion 1421 is configured to latch the mating connector 200 during mating.

The second latch arms 143 and the first latch arm 142 are sequentially arranged outward from a lateral direction of the main body portion 141. The first latch arm 142 and the second latch arms 143 are not at a same level of height, and the first latch arm 142 and the second latch arms 143 are staggered in a vertical direction. Two soldering portions 145 extend backward from the main body portion 141 out of the insulating body 11, and the two soldering portions 145 are located on two sides of the first terminals 12 and the second terminals 13.

Figure 6:
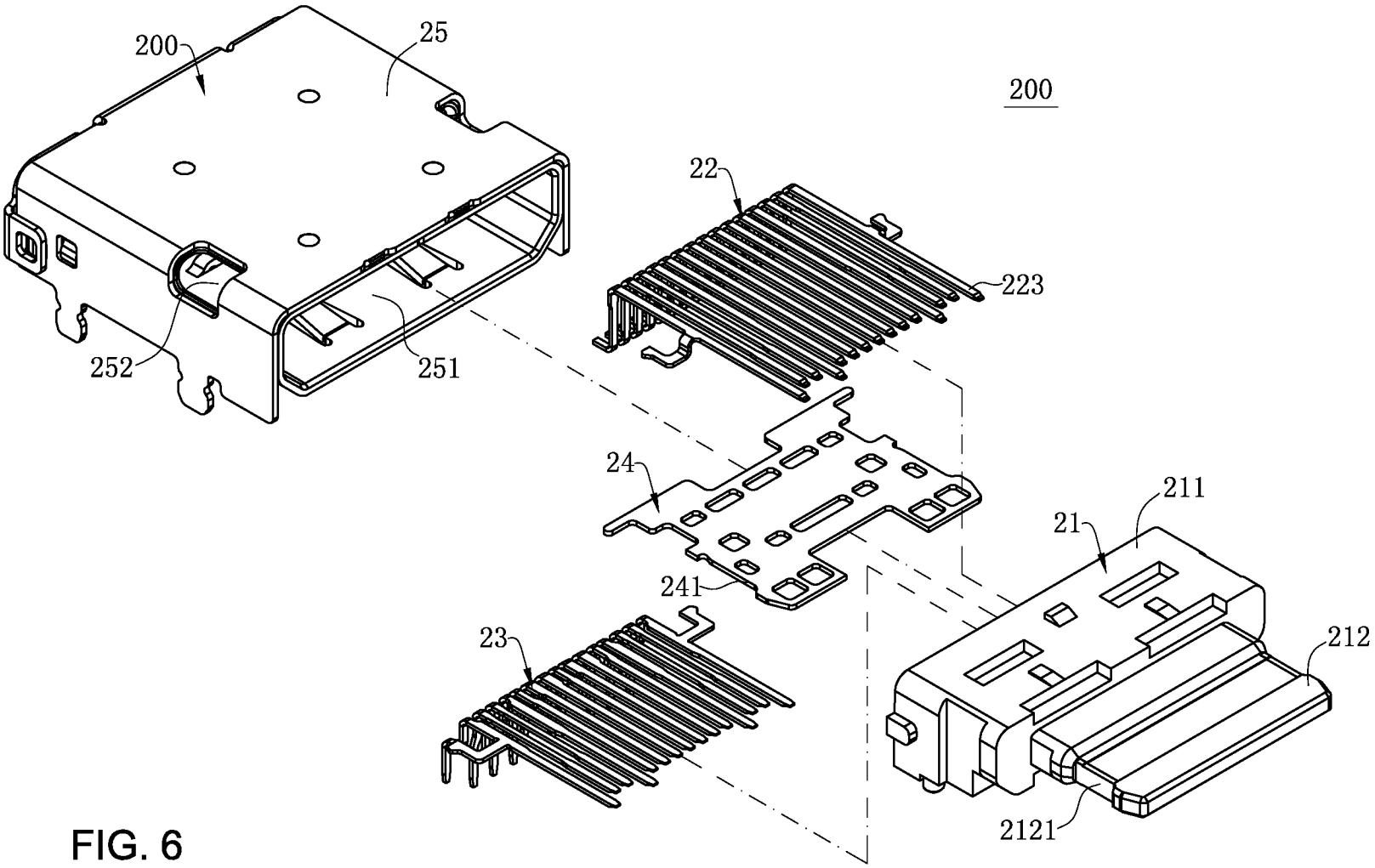
FIG. 6 is a perspective exploded view of the mating connector according to the first embodiment of the present invention.

As shown in FIG. 6, the mating connector 200 includes an insulating main body 21, which has a base 211 and a tongue 212 extending forward from the base 211. Each of two sides of the tongue 212 is provided with a groove 2121 respectively. Multiple upper-row terminals 22 are respectively retained by the base 211, and each has a mating portion 223 exposed from an upper surface of the tongue 212. Multiple lower-row terminals 23 are respectively retained by the base 211, and each has a mating portion 223 exposed from a lower surface of the tongue 212. An intermediate grounding sheet 24 is retained by the base 211 and located between the upper-row terminals 22 and the lower-row terminals 23.

Each of two sides of the intermediate grounding sheet 24 is provided with a buckling slot 241 corresponding to the groove 2121 respectively, and the buckling slots 241 are exposed from the grooves 2121. A covering shell 25 is sleeved over the insulating main body 21 and surrounds the tongue 212 to form a mating cavity 251. A penetration hole 252 is provided to penetrate from an upper surface of the covering shell 25 to the mating cavity 251.

Figure 7:
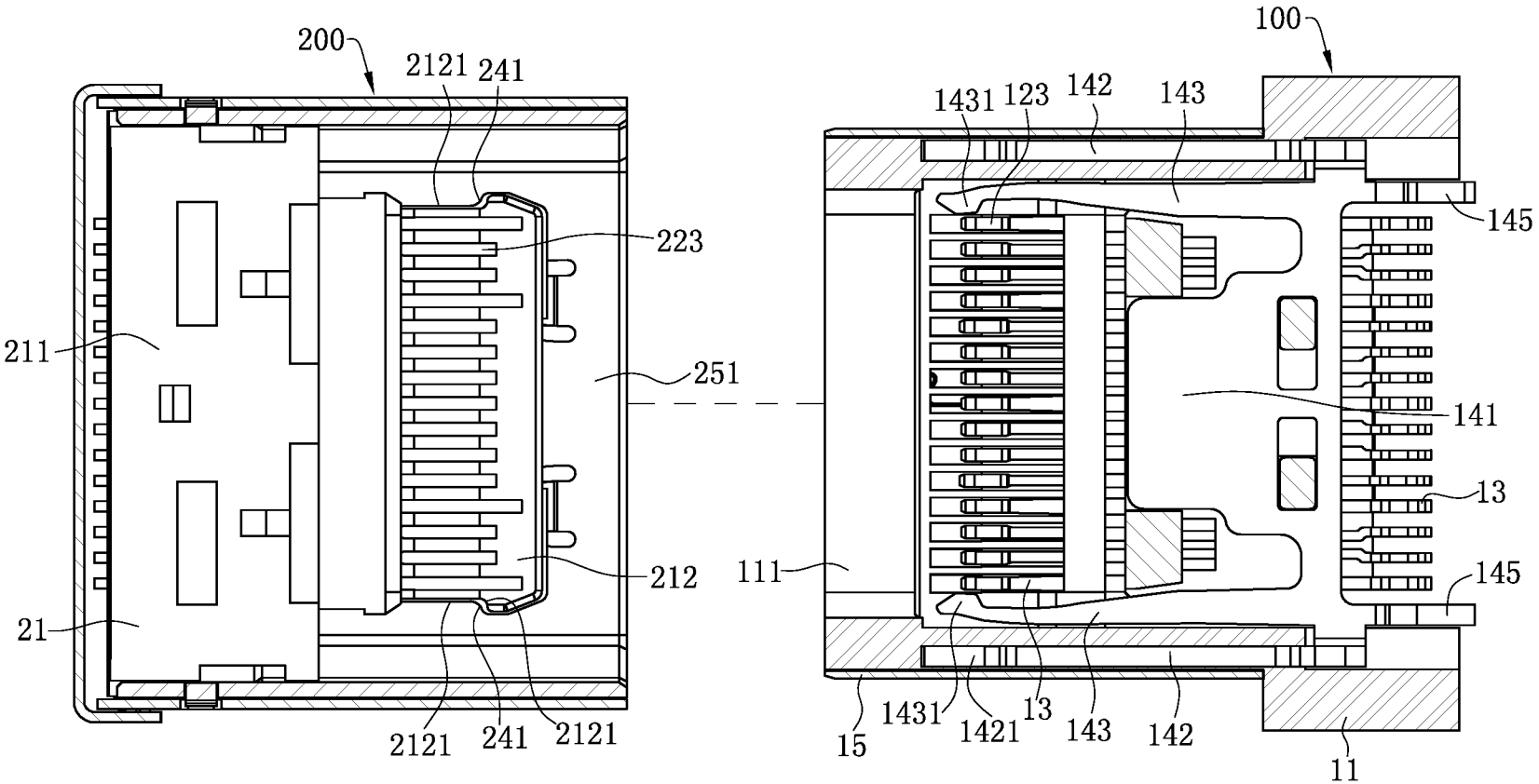
FIG. 7 is a local sectional view of the electrical connector and the mating connector according to the first embodiment of the present invention.
Figure 8:
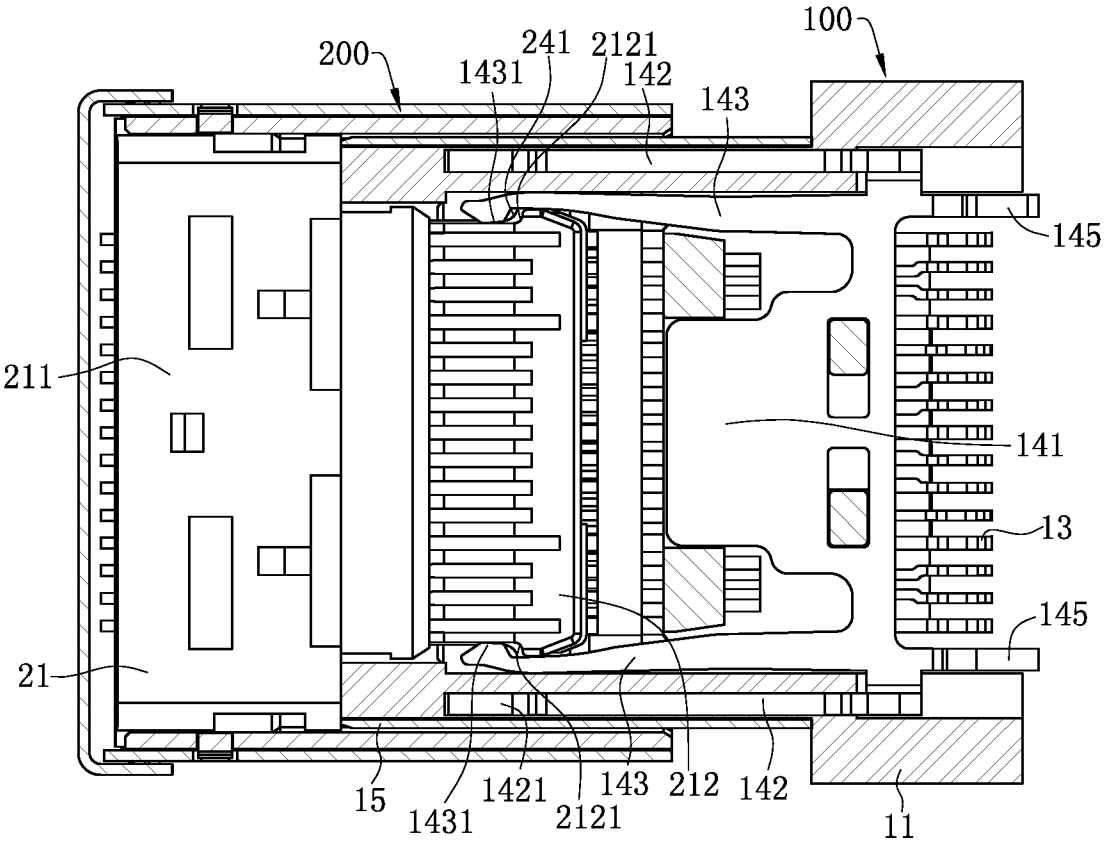
FIG. 8 is a local sectional view of the electrical connector and the mating connector during mating according to the first embodiment of the present invention.

As shown in FIG. 7 and FIG. 8, when the electrical connector 100 and the mating connector 200 are mated, the tongue 212 enters the insertion cavity 111, and each of the contact portions 123 is in contact with each of the mating portions 223. The first hook portion 1421 enters the penetration hole 252 and is exposed from the covering shell 25, and the first hook portion 1421 is fastened to the covering shell 25. The second hook portion 1431 enters the groove 2121 and is fastened to the buckling slot 241, and the second hook portion 1431 is conductive with the intermediate grounding sheet 24. Compared with the conventional electrical connector 100 which includes only one group of latch arms so that a plugging force is not sufficiently maintained, the electrical connector 100 in the embodiment is provided with the shielding sheet 14, which includes the first latch arm 142 and the second latch arms 143 not at the same level of height, so as to provide a sufficient plugging force when the electrical connector 100 is mated with the mating connector 200, so that mating is more stable.

Figure 9:
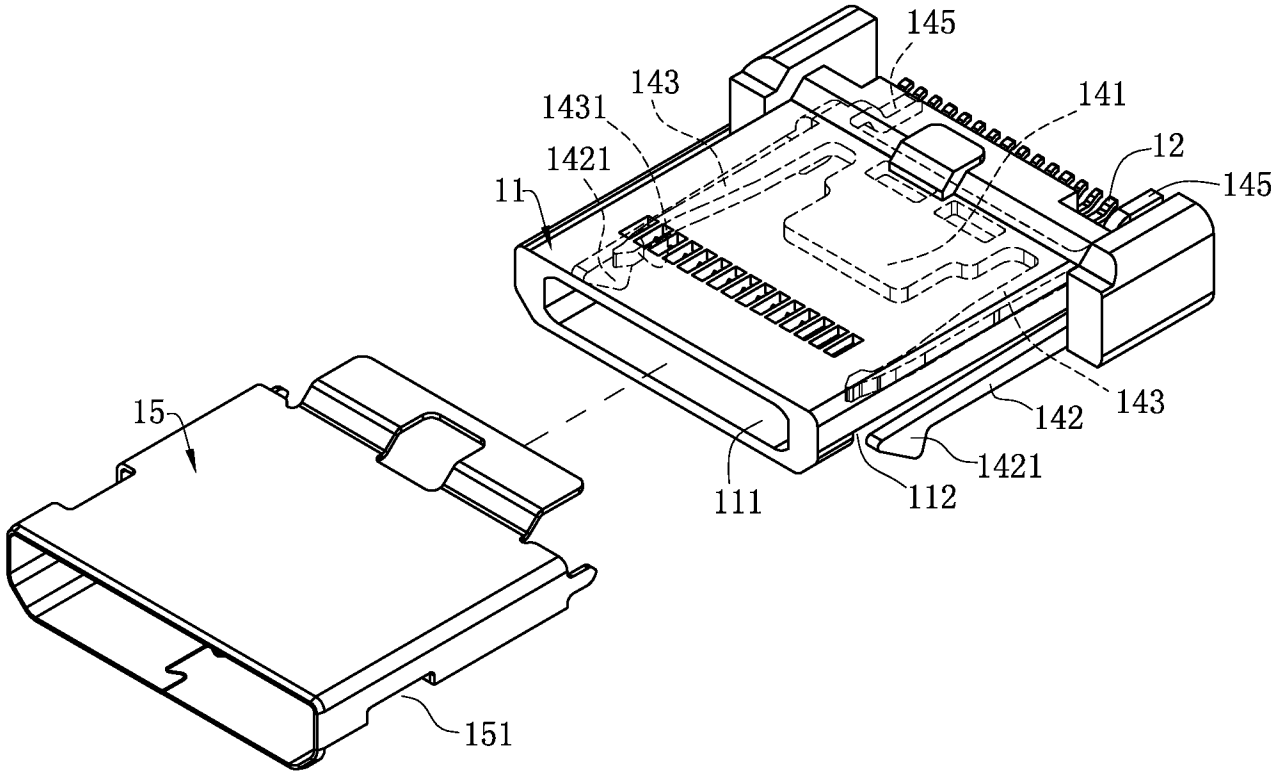
FIG. 9 is a schematic view of an electrical connector according to a second embodiment of the present invention.

FIG. 9 is a schematic view of a second embodiment of the present invention. The difference between the second embodiment and the first embodiment of the present invention lies in that the accommodating groove 112 is upward concavely provided on a lower surface of the insulating body 11, and the first latch arm 142 is accommodated in the accommodating groove 112. Further description is not elaborated herein.

Figure 10:
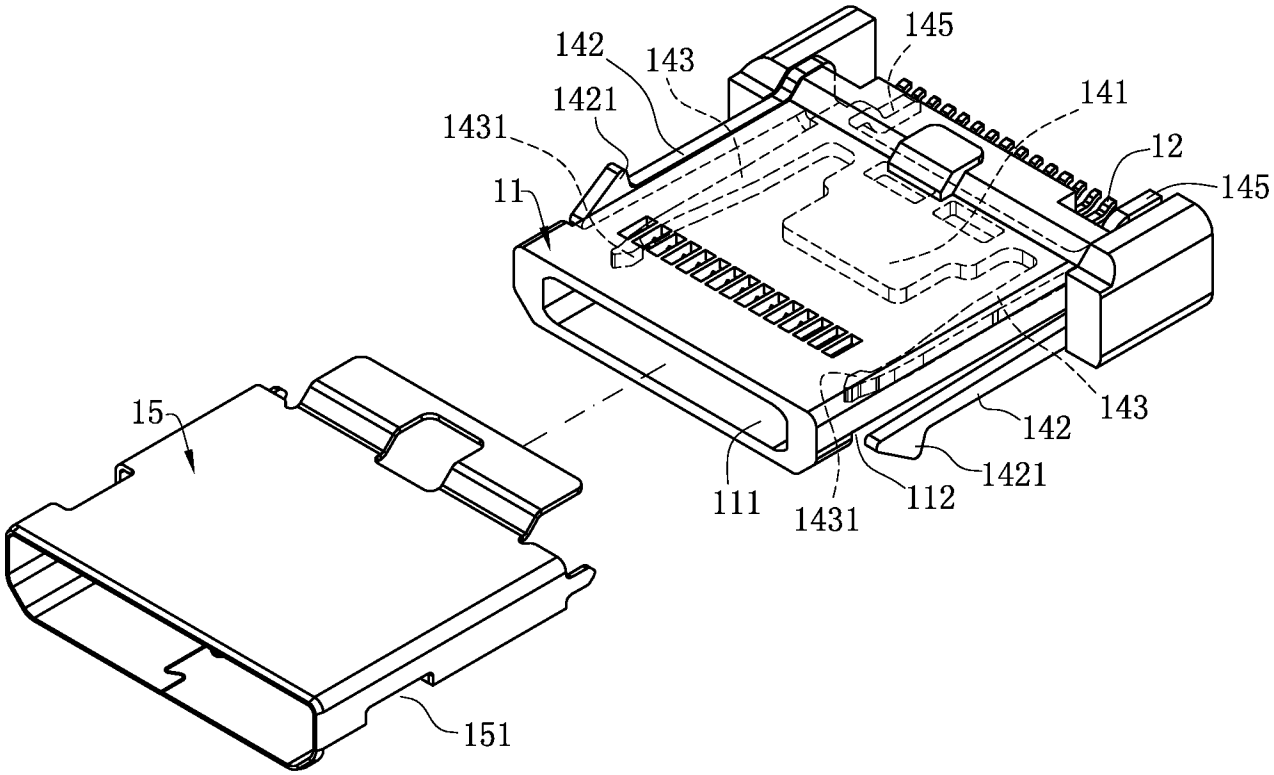
FIG. 10 is a schematic view of an electrical connector according to a third embodiment of the present invention.

FIG. 10 is a schematic view of a third embodiment of the present invention. The difference between the third embodiment and the first embodiment of the present invention lies in that an accommodating groove 112 is downward concavely provided on the upper surface of the insulating body 11, and an accommodating groove 112 is upward concavely provided on the lower surface of the insulating body 11. The first latch arms 142 are accommodated in the accommodating grooves 112. Further description is not elaborated herein.

To sum up, the electrical connector 100 according to certain embodiments of the present invention has the following beneficial effects.

(1) The electrical connector 100 of the present invention is provided with the shielding sheet 14, which has the main body portion 141 accommodated in the insulating body 11 and located between the first terminals 12 and the second terminals 13. The main body portion 141 has two of the first latch arms 142 extending out of the insulating body 11. The plate surface of each first latch arm 142 and the plate surface of the main body portion 141 form an angle, and the first latch arms 142 are configured to latch the mating connector 200 during mating. The first latch arms 142 are latched to the covering shell 25 of the mating connector 200, so as to provide a sufficient plugging force, and prevent from abrasion to the tongue 212 of the mating connector 200, thereby ensuring that the electrical connector 100 operates normally, and prolonging the service life of the mating connector 200.

(2) The main body portion 141 has two second latch arms 143, and each of the second latch arms 143 extends forward from one of two sides of the main body portion 141. The second latch arms 143 and the main body portion 141 are located on a same plane. The second latch arms 143 are located on two transverse sides of the insertion cavity 111 and partially exposed from the insertion cavity 111. The second hook portion 1431 extends from an end of each of the second latch arms 143 away from the main body portion 141 toward the insertion cavity 111. The second hook portion 1431 enters the groove 2121 and is fastened to the buckling slot 241, and the second hook portion 1431 is conductive with the intermediate grounding sheet 24. The second latch arms 143 are arranged on the basis of the first latch arms 142. Compared with the conventional electrical connector 100 which includes only one group of latch arms so that a plugging force is not sufficiently maintained, the electrical connector 100 in certain embodiments is provided with the shielding sheet 14, which includes the first latch arm 142 and the second latch arms 143 not at the same level of height, so as to provide a sufficient plugging force when the electrical connector 100 is mated with the mating connector 200, so that mating is more stable.

(3) The second latch arms 143 and the first latch arm 142 are sequentially arranged outward from a lateral direction of the main body portion 141. The first latch arm 142 and the second latch arms 143 are not at a same level of height, and the first latch arm 142 and the second latch arms 143 are staggered in a vertical direction. The first latch arm 142 and the second latch arm 143 are buckled to different positions of the mating connector 200 respectively. When the first latch arm 142 is damaged, the second latch arms 143 can continuously work, so as to ensure that the electrical connector 100 can be normally plugged.

(4) A bending portion 144 bends and extends upward vertically from a rear end of each of the second latch arms 143. The first latch arm 142 extends forward from the bending portion 144. That is, the first latch arm 142 and the second latch arm 143 of the shielding sheet 14 are integrally formed, thereby ensuring simple forming and saving manufacturing procedures.

(5) When the electrical connector 100 and the mating connector 200 are mated, the tongue 212 enters the insertion cavity 111, and each of the contact portions 123 is in contact with each of the mating portions 223. The first hook portion 1421 enters the penetration hole 252 and is exposed from the covering shell 25, and the first hook portion 1421 is fastened to the covering shell 25. The second hook portion 1431 enters the groove 2121 and is fastened to the buckling slot 241, and the second hook portion 1431 is conductive with the intermediate grounding sheet 24. Compared with the conventional electrical connector 100 which is conducted and grounded only by the intermediate grounding sheet 24, the electrical connector 100 in certain embodiments is provided with the shielding sheet 14, which is conductive with both the covering shell 25 and the intermediate grounding sheet 24, thus providing two grounding paths, such that the grounded shielding effect of the electrical connector 100 is better, and operation is more stable.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be mated with a mating connector, comprising:

an insulating body, wherein a front end of the insulating body is backward concavely provided with an insertion cavity;

a plurality of first terminals and a plurality of second terminals, accommodated in the insulating body respectively, the first terminals being partially exposed from a top surface of the insertion cavity, and the second terminals being partially exposed from a bottom surface of the insertion cavity;

a shielding sheet, accommodated in the insulating body, and having a main body portion located between the first terminals and the second terminals, wherein the main body portion has at least one first latch arm extending out of the insulating body, and a plate surface of the at least one first latch arm and a plate surface of the main body portion form an angle; and a shielding shell, covering the insulating body, the shielding shell having an accommodating hole corresponding to the at least one first latch arm, wherein the at least one first latch arm is partially located in the accommodating hole and partially protruding out from the shielding shell, such that a portion of the at least one first latch arm protruding out from the shielding shell is configured to latch the mating connector during mating.

2. The electrical connector of claim 1, wherein the plate surface of the at least one first latch arm is perpendicular to the plate surface of the main body portion.

3. The electrical connector of claim 1, wherein at least one accommodating groove is downward concavely provided on an upper surface of the insulating body or upward concavely provided on a lower surface of the insulating body, and the at least one first latch arm is accommodated in the at least one accommodating groove.

4. The electrical connector of claim 1, wherein:

the main body portion has at least two first latch arms, and at least two accommodating grooves are correspondingly provided on the insulating body;

one of the at least two accommodating grooves is downward concavely provided on an upper surface of the insulating body, and another one of the at least two accommodating grooves is upward concavely provided on a lower surface of the insulating body; and the at least two first latch arms are respectively accommodated in the at least two accommodating grooves.

5. The electrical connector of claim 1, wherein each of the at least one first latch arm has a first hook portion, the first hook portion extends from an end of each of the at least one first latch arm away from the main body portion, the first hook portion extends away from the insertion cavity, the first hook portion is partially located in the accommodating hole and partially protruding out from the shielding shell, and the first hook portion is configured to latch the mating connector during mating.

6. The electrical connector of claim 1, wherein each of two sides of the main body portion is provided with a bending portion, and the bending portion is connected to the at least one first latch arm.

7. The electrical connector of claim 1, wherein at least one soldering portion extends backward from the main body portion out of the insulating body.

8. The electrical connector of claim 1, wherein the main body portion further has two second latch arms, each of the second latch arms extends forward from one of two sides of the main body portion, the second latch arms are located on two transverse sides of the insertion cavity and exposed from the insertion cavity, and the main body portion and the second latch arms are located on a same plane.

9. The electrical connector of claim 8, wherein the second latch arms and the at least one first latch arm are not located at a same level of height.

10. The electrical connector of claim 8, wherein the at least one first latch arm and the second latch arms are staggered in a vertical direction.

11. The electrical connector of claim 8, wherein the second latch arms and the at least one first latch arm are sequentially arranged outward from a lateral direction of the main body portion.

12. The electrical connector of claim 8, wherein each of the second latch arms has a second hook portion, the second hook portion extends from an end of each of the second latch arms away from the main body portion, the second hook portion extends into the insertion cavity, and the second hook portion is configured to latch the mating connector during mating.

13. The electrical connector of claim 8, wherein each of two sides of each of the second latch arms is provided with a bending portion, and the bending portion is connected to the at least one first latch arm.

14. An electrical connector, configured to be mated with a mating connector, comprising:

an insulating body, wherein a front end of the insulating body is backward concavely provided with an insertion cavity;

a plurality of first terminals and a plurality of second terminals, accommodated in the insulating body respectively, the first terminals being located on a top surface of the insertion cavity, the second terminals being located on a bottom surface of the insertion cavity, and each of the first terminals and each of the second terminals having a contact portion exposed from the insertion cavity respectively;

a shielding sheet, accommodated in the insulating body, and having a main body portion located between the first terminals and the second terminals, wherein the main body portion has at least one first latch arm extending out of the insulating body, a plate surface of the at least one first latch arm and a plate surface of the main body portion form an angle, the main body portion further has two second latch arms, each of the second latch arms extends forward from one of two sides of the main body portion, the second latch arms are located on two transverse sides of the insertion cavity and exposed from the insertion cavity, the second latch arms and the at least one first latch arm are not located at a same level of height, and the at least one first latch arm and the second latch arms are configured to latch the mating connector during mating; and a shielding shell, covering the insulating body, the shielding shell having an accommodating hole corresponding to the at least one first latch arm, wherein the at least one first latch arm is located in the accommodating hole and partially exposed from the shielding shell.

15. The electrical connector of claim 14, wherein the plate surface of the at least one first latch arm is perpendicular to the plate surface of the main body portion.

16. The electrical connector of claim 14, wherein at least one accommodating groove is downward concavely provided on an upper surface of the insulating body or upward concavely provided on a lower surface of the insulating body, and the at least one first latch arm is accommodated in the at least one accommodating groove.

17. The electrical connector of claim 14, wherein there are two first latch arms, a first hook portion extends from an end of each of the two first latch arms away from the main body portion, the first hook portion extends away from the insulating body, the first hook portion is located in the accommodating hole and exposed from the shielding shell, and the first hook portion is configured to latch the mating connector during mating.

18. The electrical connector of claim 14, wherein the second latch arms and the main body portion are on a same plane.

19. The electrical connector of claim 14, wherein each of the second latch arms has a bending portion, the bending portion is connected to the at least one first latch arm, and the at least one first latch arm and the second latch arms are staggered in a vertical direction.

20. The electrical connector of claim 14, wherein a second hook portion extends from an end of each of the second latch arms away from the main body portion, the second hook portion extends into the insertion cavity, and the second hook portion is configured to latch the mating connector during mating.

* * * * *